United States Patent [19]

Yamamoto et al.

[11] 4,384,844

[45] May 24, 1983

[54] LOAD DRIVE CONTROL ELEMENT CHECK CIRCUIT

[75] Inventors: Yuji Yamamoto, Fujisawa; Sei Shiragaki, Yamatoshi, both of Japan

[73] Assignee: Yamatake-Honeywell Co., Ltd., Tokyo, Japan

[21] Appl. No.: 222,407

[22] Filed: Jan. 5, 1981

[30] Foreign Application Priority Data

Jan. 24, 1980 [JP] Japan ..... 55-6356

[51] Int. Cl.[3] ..... F23N 5/26

[52] U.S. Cl. ..... 431/14; 340/825.5; 431/24; 431/26; 165/11 R

[58] Field of Search ..... 431/14, 26, 24; 62/127, 62/126; 236/94; 165/11 R; 340/825.5

[56] References Cited

U.S. PATENT DOCUMENTS

| | | | |
|---|---|---|---|
| 3,781,161 | 12/1973 | Schuss | 431/26 X |
| 4,278,419 | 7/1981 | Bechtel et al. | 431/24 |
| 4,295,129 | 10/1981 | Cade | 236/94 X |

FOREIGN PATENT DOCUMENTS

| | | |
|---|---|---|
| 46-31905 | 9/1971 | Japan . |
| 49-28944 | 8/1974 | Japan . |
| 51-18654 | 6/1976 | Japan . |
| 54-12317 | 5/1979 | Japan . |

*Primary Examiner*—William E. Wayner

*Attorney, Agent, or Firm*—Clyde C. Blinn

[57] ABSTRACT

The present disclosure relates to a load drive control element check circuit for checking whether or not conduction and non-conduction troubles take place in a load controlling switching element at the final output stage of a control device, which is required for safety, such as a combustion control circuit.

8 Claims, 3 Drawing Figures

LOAD DRIVE CONTROL ELEMENT CHECK CIRCUIT

BACKGROUND AND SUMMARY OF THE INVENTION

In a temperature regulating device or a combustion control device, when a motor, an igniter, a fuel feed value or a pump, or a heater is to be driven, the conduction or non-conduction of such load is controlled by a semiconductor switch control element or relay. If, in this case, a conduciton problem occurs in a switching element, the danger arises that the load is driven irrespective of the existence of a final control output signal. As a countermeasure therefor, in the analog control device according to the prior art, a first method has been practiced in which the load such as the relay is constructed into a special fail-safe circuit; a second method, in which a plurality of switching elements are connected in parallel; and a third method, in which the final stage circuit is so constructed that the load is made to work safely, even if a conduction problem occurs in the final stage, by the action of the remaining circuit. Specifically, the first method is disclosed in Japanese Patent Publications Nos. 54-12317 and 46-31905, and in Japanese Utility Model Publication No. 51-28944, and the third method is disclosed in Japanese Patent Publication No. 51-18654.

All of these methods have been practiced by making the circuit itself fail-safe or doubly safe. In the recent digital control device, however, to make the circuit fail-safe on the basis of such concept is accompanied by serious difficulties.

The present invention contemplates providing a novel check circuit for the conduction problem of a load control element while succeeding in overcoming such difficulty.

BRIEF DESCRIPTION OF THE DRAWING

FIG. 2(*b*) is a sequence diagram showing the operation sequence of the same embodiment.

DESCRIPTION OF THE INVENTION

Figure 1:
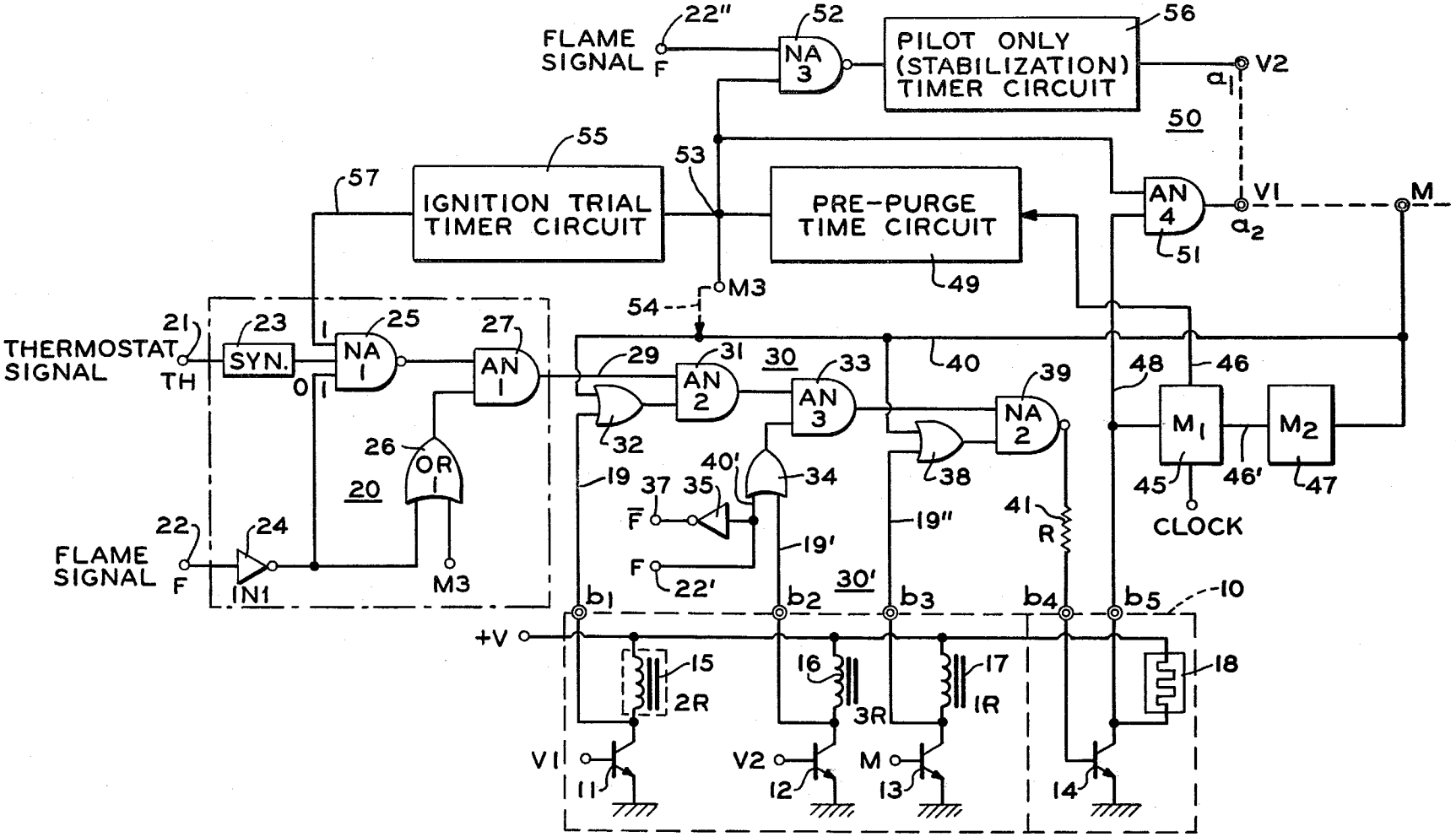
FIG. 1 is a circuit diagram in case the load drive control check circuit according to one embodiment of the present invention is applied to the combustion control device.
Figure 2A:
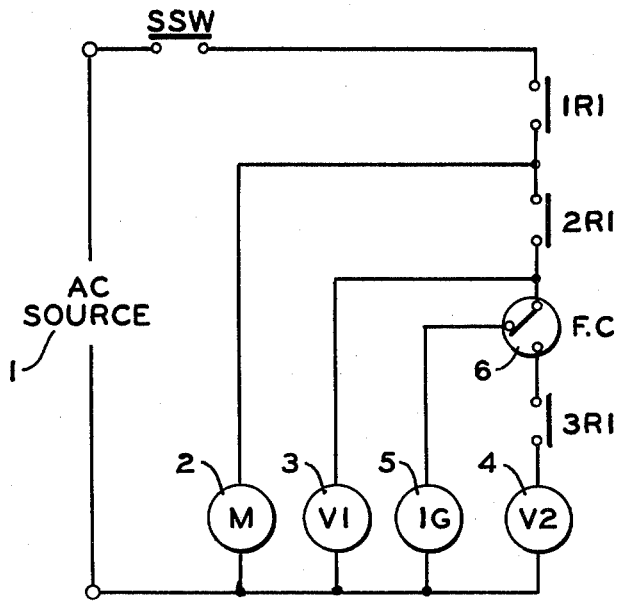
FIG. 2(*a*) shows the load energization circuit of the same embodiment.
Figure 2B:
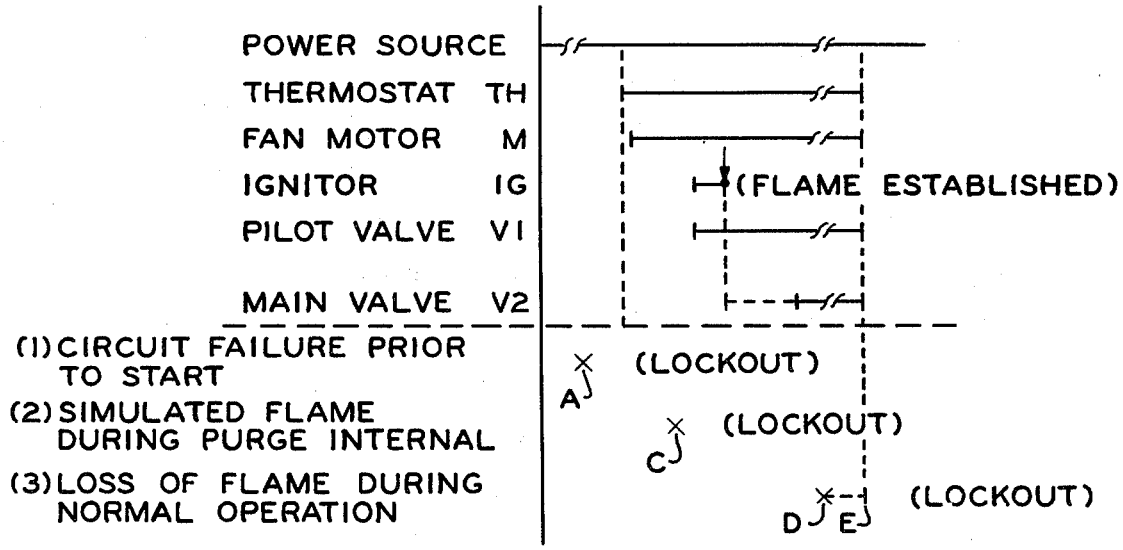

Indicated at reference numeral 10 FIG. 1 is a load drive circuit which has four transistors 11, 12, 13 and 14 connected at their respective collectors with load control relays 15, 16 and 17 and a safety break switch drive element 18. Relays 1R, 2R, 3R have respective output contacts 1R1, 2R1, and 3R1 connected with well-known gas combustion control device energization circuits, respectively, as shown in FIGS. 2(*a*). All the circuits other than the load drive circuit 10 shown in broken lines are made digital and integrated. Among them, numeral 20 indicates a first condition discriminating circuit, which has its terminal 21 fed with a heat requiring signal from a starter switch or a thermostat (although not shown) such that it receives the signal at a level "1", when there is the heat requirement, and the signal at a level "0", where there is no heat requirement, and its terminal 22 fed with a flame signal from a combustion flame detector (although not shown) such that it receives the signal at the level 37 1", when a flame exists, and the signal at the level "0" when no flame exists. Moreover, an NAND gate 25, an OR gate 26 and an AND gate 27 are connected in the manner shown. On the other hand, output 29 of the first condition discriminating circuit 20 is connected with a second condition discriminating circuit which is disposed at the next stage and which is composed of two AND gates 31 and 33 and an NAND circuit 39. These respective gates have their gates connected with OR gates 32, 34 and 38 which constitute a detecting circuit 30'. Into those OR gates 32, 34 and 38, there are introduced conduction trouble detecting lines 19, 19' and 19'' which lead from the collectors of the respective transistors of the load drive circuit 10 connected at the outside of the integrated circuit, and an output signal indicative of the control operation condition of the combustion control device is impressed upon a conductor 40 or 40'.

Terminals 22' and 37 are gate inputs for checking the flame signal. The output of the NAND gate 39 is connected through a resistor 41 with the transistor 14 to control the safety break switch energization portion 18 connected with the collector thereof and to feeding a latch circuit 45 and an AND gate 51 with a signal indicative of the energization condition thereof. There is further provided a memory circuit 47, from the output of which a fan motor drive terminal M is led out as an external terminal and is connected with the gate of the transistor 13 thereby to control the relay 1R. On the other hand, a latch output 46 energizes well-known digital timer circuits 49 and 55 for pre-purge and ignition trial. From the output of the AND gate 51 which is made receptive of a pre-purge termination signal 53 and a safety switch energization condition signal 48, there is generated as the terminal a first combustion valve energization output signal V1, which is then applied to the base of the transistor 11 thereby to energize the relay 2R. On the other hand, at the output of a NAND gate 52 which is made receptive of a flame signal F22' and the pre-purge termination signal 53, a timer 56 is disposed for a pilot safety time, the output V2 of which is externally connected with the base of the transistor 12.

With the construction thus far described, the normal operation, in which the transistors 11, 12, 13 and 14 have no conduction problem will be described. First of all, assume that the respective logic circuits are fed in advance with an electric power similar to the usual digital device. Since no flame exists at the beginning, the outputs of the NAND gate 25 and the AND gates 27 and 31 are at the level "1", and the output of the NAND gate 39 is at the level "0" so that the safety switch stands by under its inoperative condition. When the thermostat is turned on, all the inputs of the NAND gate 25 are at the level "1", whereas the output of the AND gate 27 is at the level "0". Since, at this time, the respective transistors 11, 12 and 13 are all under their "OFF" condition, the inputs of detecting terminals $b_1$, $b_2$ and $b_3$ are all at the level"1". At this time, the output of the terminal M is at the level "0", because the motor is not driven yet, and the outputs of the respective AND gates 31 and 33 are at the level "0". In response to the output of the NAND gate 39 at the level "1", the transistor 14 temporarily tries the inversion operation. At this time, the input of the latch 35 is at the level "0", and the pre-purge starting signal 46 is generated by an instant clock so that the operation of the timer 49 is started. The signal indicative of the start of that operation is generated from the output 57 of the timer 55 to instantly invert the output 57 from the level "1" to the level "0". As a result, the output of the AND gate 27 restores the level "1", and the outputs of the AND gates 31 and 33 also restore the level "1" so that the output of the NAND gate 39 is reduced to the level "0" to stop the operation of the transistor 14. Since the check operation is performed during the period of the one pulse of the clock of about 100 Hz, the period until that instant is so preset that the safety switch fails to reach its breaking operation. Consequently, the latch circuit 45 is inverted again to feed the memory circuit 47 with a signal 46' at the level "1" so that the control operation output signal is fed from the terminal M to the transistor 13 and the OR gates 32 and 38. Consequently, the relay 1R is energized, and the operation output signal is generated after the end of the pre-purge period from the AND gate 51 to the first fuel feeding device, i.e., a pilot valve V1 so that the ignition trail operation is performed by the connection shown in FIG. 2(*a*). When the ignition is established, the igniter is de-energized by a flame relay (although not shown) connected with the outside so that the NAND gate 52 is energized by the flame signal 22'' indicative of the fact that ignition has been effected. The energization signal to a main valve V2 is fed to the transistor 12 through the pilot safety timer circuit 56 thereby to energize a main valve 2 shown in FIG. 2. As a result, a normal combustion is entered. The operation sequence thus far described is illustrated in FIG. 2(*b*).

OPERATION OF THE INVENTION

During the steady combustion run, however, since all the transistors 11, 12 and 13 are being made conductive and energized, the problems, if any, in the transistors 11, 12 and 13 cannot be checked. Therefore, in the present embodiment, the checking operation is stopped by impressing the OR gate detecting circuit once with the motor output M by which the combustion operation sequence is started.

Nest, we will consider the case in which the conduction problem takes place in the transistors 11, 12 and 13. As shown in the lower portion of FIG. 2(*b*), more specifically:

(1) If any of the transistors 11, 12 and 13 is rendered conductive prior to the start by the thermostat, the signal at the level "0" appears in any of the terminals $b_1$, $b_2$ and $b_3$ so that any of the relays 1R, 2R and 3R is energized. At this time, however, since all of the operation output signals 40 and 40' are simultaneously at the level "0", the level "0" appears in the output of any of the OR gates 32, 34 and 38. Prior to the start, the output of the AND gates 27 is at the level "1", and the NAND gate 39 is inverted from the level "0" to the level "1" in response to the "0" signal from that OR gate detecting circuit to energize the safety switch 18 several seconds later or instantly thereby to block the power supply to a contact SSW shown in FIG. 2 and the present control circuit. As is different from the analog control device according to the prior art, since the digital combustion control device is fed with its power independently of the starter switch such as the thermostat, the aforementioned blocking operation can be effected before the heat requirement is made.

Next, during the pre-purge period (2), if either of the transistors 11 and 12 is rendered conductive, the combustion sequence has already been started. In this case, therefore, it is sufficient that the control operation output signal to be fed to the input of the OR gate 32 does not not resort to the motor output M, i.e., the signal 40 but resorts to a pr-purge termination signal 54. Thus, the conduction problem during the pre-purge operation can be checked to energize the break switch.

Moreover, if the transistors 11, 12 and 13 are troubled to become conductive during the subsequent normal operation (3), the checking operation during this period is impossible because the respective transistors 11, 12 and 13 are to be intrinsically energized. At the instant when the combustion sequence is once terminated by the stop of the heat requirement or the quenching operation of the flame, the safety switch is energized by the aforementioned operations so that the subsequent sequence can be inhibited.

In the present embodiment, the transistor 14 is once energized in an instant manner by the use of the known latch circuit 45, as has been described hereinbefore. In view of the inversion phenomena, the latch circuit is energized so that the cycling operation, by which the operation of the transistor 14 is returned again to its normal condition in response to the signal of the timer 55, is accomplished at the start. Thus, the non-conduction trouble condition of the transitor 14 for the energization of the safety break switch is checked. If the non-conduction takes place, the latch does not perform the inversion operation. As a result, neither the output M nor the timer circuits 49 and 55 are energized so that the checking operation can be effected in a remarkably safe manner without allowing the combustion sequence operation to advance. Incidentially, this is because the conduction trouble in the case of the transistor 14 raises no serious problem but the non-conduction trouble is predicted to raise a dangerous condition.

As has been described herein, according to the present invention, the digital control device can be energized to the safety side against the conduction problem of the load drive control element partly by using the fact that the digital control device is always fed with the electric power and partly by using the time band other than that for which the respective control elements for the load energization are to be energized in the operational sequence, and the digital control device can also be safely controlled merely by providing the conduction detecting terminal especially in case the digital control device is integrated, thus making it possible to provide a remarkably simple and novel check circuit.

The embodiments of the invention in which an exclusive property or right is claimed are defined as follows:

1. A load drive control element check circuit comprising:

a load drive circuit for controlling the enrergization and de-energization of a load in accordance with the conduction and non-conduction of a load drive control element;

a control circuit for feeding a control operation output signal to said load drive circuit thereby to energize said control element;

a detecting circuit for detecting the existence of a conduction trouble condition signal in said control element, and providing a condition signal, and a condition discriminating circuit for discriminating the conduction trouble of said control element through a gate circuit which is made receptive of both said control operation output signal of said control circuit and said condition signal of said detecting circuit.

2. A load drive control element check circuit as set forth in claim 1, wherein said load drive circuit uses a combustion fan motor or a fuel feeding device as said load.

3. A load drive control element check circuit comprising:

a load drive circuit for controlling the energization and de-energization of a load in accordance with the conduction and non-conduction of a load drive control element;

a control circuit for feeding a control operation signal to said load drive circuit thereby to energize said control element;

a detecting circuit for detecting the existence of a conduction trouble condition signal in said control element; and providing a condition signal, and a first condition discriminating circuit for feeding an operation command output to said control circuit in accordance with the condition of a starter switch or a flame signal, wherein there is provided a second condition discriminating circuit for discriminating the conduction trouble of said control element through a gate circuit which is made receptive of said control operation output signal of said control circuit, said condition signal of said detecting circuit and said operation command output.

4. A load drive control element check circuit as set forth in claim 3, wherein said load drive circuit uses a combustion fan motor or a fuel feeding device as said load.

5. A load drive control element check circuit as set forth in claim 4, wherein the control operation output signal of said control circuit is selectively set at the energization operation output signal of said combustion fan motor or a pre-purge timing termination signal.

6. A load drive control element check circuit as set forth in claim 5, wherein said gate circuit includes: an OR gate made receptive of said control operation signal and said condition signal; and an AND gate made receptive of the output of said OR gate and said operation command output.

7. A load drive control element check circuit as set forth in claim 6, further comprising a safety break switch circuit for the operation of said control circuit in response to said condition signal indicative of the conduction trouble of said control element.

8. A load drive element check circuit as set forth in claim 7, wherein the conduction trouble of the control element for energizing said safety break switch circuit is subjected to a cycling inversion operation from "OFF" to "ON" and again to "OFF" in response to the output of said second condition discriminating circuit so that the non-conduction trouble of said control element may be checked by said cycling inversion operation.

* * * * *

UNITED STATES PATENT OFFICE

CERTIFICATE OF CORRECTION

PATENT NO. : 4,384,844

DATED : May 24, 1983

INVENTOR(S) : Yuji Yamamoto and Sei Shiragaki

It is certified that error appears in the above-identified patent and that said Letters Patent are hereby corrected as shown below:

In claim 7, column 6, line 16, after "for" insert --stopping--.

Signed and Sealed this

*Twenty-sixth* Day of *July 1983*

[SEAL]

*Attest:*

GERALD J. MOSSINGHOFF

*Attesting Officer*

*Commissioner of Patents and Trademarks*